United States Patent [19]

Grabb

[11] 4,107,967

[45] Aug. 22, 1978

[54] ACCESS-LIMITING APPARATUS

[76] Inventor: William C. Grabb, 325 Barton Shore Dr., Ann Arbor, Mich. 48105

[21] Appl. No.: 859,220

[22] Filed: Dec. 12, 1977

[51] Int. Cl.[2] ..... E05B 17/18

[52] U.S. Cl. ..... 70/427; 70/455

[58] Field of Search ..... 70/163, 164, 165, 166, 70/167, 168, 169, 423, 424, 425, 426, 427, 428, 345, 387, 455, DIG. 56

[56] References Cited

U.S. PATENT DOCUMENTS

| | | | |
|---|---|---|---|
| 2,883,849 | 4/1959 | Lorenzo | 70/427 |
| 3,125,873 | 3/1964 | Robinson | 70/166 |
| 3,714,804 | 2/1973 | French | 70/455 |

*Primary Examiner*—Robert L. Wolfe
*Attorney, Agent, or Firm*—Olsen and Stephenson

[57] ABSTRACT

Access-limiting apparatus comprising a body through which an access passageway is formed. A second passageway is formed in the body at a position intersecting the access passageway and a lock plate is slidably movable in the second passageway to a locked position closing the access passageway. Locked means on the lock plate and the body cooperate to secure the lock plate in the locked position. A key plate which is matched with the lock plate is provided with lock release means operable to engage the lock means so as to release the lock plate from the body.

11 Claims, 7 Drawing Figures

ACCESS-LIMITING APPARATUS

BACKGROUND OF THE INVENTION

Conventional locks, in many instances, do not adequately prevent an illegal entry. The problem is particularly acute for owners of lodging establishments because courts are more frequently holding them responsible for injuries to their guests as a result of the failure of the security system in preventing a break-in. Yet, a person with little experience can usually open a locked door. The problem is further aggravated because each guest who receives a key to his room has the opportunity to have a duplicate key made enabling a later unauthorized entry to the room. Continually changing the locks is prohibitively expensive and thus is an unrealistic solution. Therefore, there is a need for an unexpensive auxiliary tamper-proof lock device which effectively limits access to a desired location.

In areas such as an office in which many people are present, it is necessary to have certain controls such as light switches, thermostats, machine controls, etc., located at positions in which only authorized personnel have access. Thus, a tamper-proof lock device is also desirable for these installations.

It is a general object of the present invention, therefore, to provide an access limiting device which enables only authorized access to be gained to a desired location.

It is a more particular object of the present invention to provide a tamper-proof lock device for conventional door locks.

SUMMARY OF THE INVENTION

In accordance with the present invention, access-limiting apparatus is provided comprising a body which is mounted in covering relation over a location to which access is to be limited such as a keyhole on a door lock, a switch, a thermostat, etc. The body has front and rear faces or walls and an access passageway is formed through the body extending through the front and rear faces to expose the door lock, for example. A second passageway is formed in the body that extends transversely with and intersects the access passageway. A lock plate is provided which is slidably movable in the second passageway to a locked position closing the access passageway. Lock means on the lock plate and the body serve to secure the lock plate in its locked position. A plurality of movable pin members are mounted on the body so that they extend across the second passageway in spaced apart positions spaced from the access passageway. Pin retainer means is formed on the lock plate to engage a preselected number of the pin members in the locked position of the lock plate so as to prevent release of the lock plate from the body.

A key plate, matched with the lock plate, is provided with lock release means and is movable in the second passageway to a position in which the lock release means engages the pin members to move them out of engagement with the pin retaining means on the lock plate to enable the release of the lock plate from the body. The pin retaining means on the lock plate and the lock release means on the key plate are matched so that the key plate will only release its matched lock plate. Consequently, an unmatched key plate will be ineffective to move all of the pin members out of engagement with the lock plate, in which case the lock plate will remain secured in its locked position.

In one embodiment of the present invention, the pin members are mounted to the body and are bendable between a first position and a second position displaced from the first position. The pins are biased toward their first positions. The lock plate is provided with a series of channels having angled surfaces or walls and a plurality of horzontal recesses positioned above the angled surfaces so that in response to movement of the lock plate toward its locked position, the angled surfaces engage and bend selected pin members to their second positions. Further movement of the lock plate aligns the pin members with the recesses so that they return to their first positions in engagement with the pin keepers thereby securing the lock plate in its locked position. The key plate is also provided with a series of channels having angled surfaced which engage the pin members moving them out of engagement with the lock plate when the key plate is moved toward the pin members enabling the removal of the lock plate from the body to open the access passageway.

The present invention thus provides lock apparatus that can readily be applied to a variety of security situations so as to improve security.

Further objects, features, and advantages of the present invention will become apparent from a consideration of the following description when taken in connection with the appended claims and the accompanying drawing in which:

Figure 1:
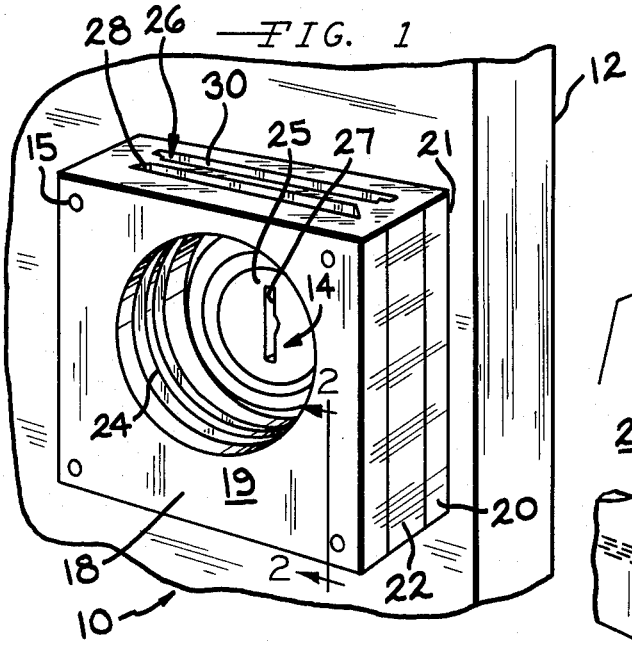
FIG. 1 is a perspective view of the apparatus of the present invention mounted in covering relation over a machine control.
Figure 2:
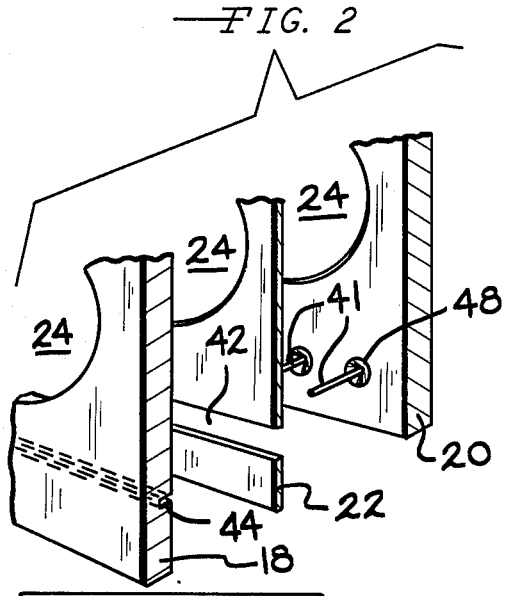
FIG. 2 is an exploded perspective view of the access-limiting apparatus taken substantially from lines 2—2 in FIG. 1.

Referring to the drawing, the access-limiting apparatus of the present invention, indicated generally at 10 in FIG. 1, is shown mounted on a machine 12 having a key-operated control mechanism 14. The apparatus 10 is mounted on the machine 12 by bolts 15, although any suitable attaching means can be satisfactorily employed to fasten the apparatus 10 to the machine 12.

The apparatus 10 comprises a main body 16 formed of a front plate member 18 having a front face or wall 19, a rear plate member 20 having a rear face or wall 21, and a center plate member 22. The plate members 18, 20, and 22 are suitably connected such as by welding to form the body 16.

An access or first passageway 24 is formed through the body 16 and extends longitudinally thereof through the plates 18, 20, and 22 forming aligned openings in the front and rear faces 19 and 21, respectively. It is seen that the body 16 is mounted on the machine 12 so that the passageway 24 is aligned with the rotating locking cylinder 25 in the control 14. It can thus be seen that the body 16 is mounted on the machine 12 so that the passageway 24 is aligned with the rotatable locking cylinder 25 in the control 14. The cylinder 25 contains the usual key-receiving slot 27 in which a key (not shown) can be inserted to operate the control mechanism 14 to enable operation of the machine 12.

A second passageway 26 is formed in the body 16 extending transversely of and intersecting the passageway 24. In the illustrated embodiment, the second passageway 26 comprises a pair of rectangular channels 28 and 30 which are formed in the body 16. The front channel 28 extends downwardly through the top of the body 16 forming a generally rectangular space between the front plate 18 and the middle plate 22. The rear channel 30 extends downwardly through the top of the body 16 forming a second rectangular space between the rear plate 20 and the center plate 22. Accordingly, the channels 28 and 30 are formed between the front and rear walls 19 and 21 of the body 16 and intersect the passageway 24.

Figure 4:
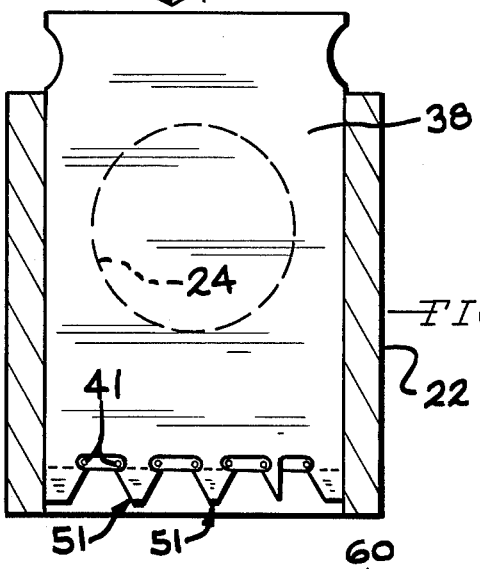
FIG. 4 is a sectional view like FIG. 3 showing the lock plate fully inserted to a locked position.

The access passageway 24 is selectively blocked to prevent access to the key slot 27 by a lock plate 38. The lock plate 38 has a generally rectangular configuration, corresponding with the rectangular shape of the front channel 28. A pair of indentations 40 are formed on opposite sides of the plate 38 near its top serving as a handle for grasping the lock plate 38. The lock plate 38 is slidably movable in the forward channel 28 to a locked position, shown in FIG. 4, in which the passageway 24 is blocked and the lock plate 38 is secured in place.

Lock means are formed on the lock plate 38 and the body 16 to secure the lock plate 38 in its locked position. The lock means includes a plurality of pin members 41 mounted on the body 16 so as to extend across the channels 28 and 30. A horizontally elongated opening 42 is formed in the plate 22 below the access passageway 24 and an aligned slot 44 is formed in the rear surface of the front plate 18 so as to open toward the middle plate 22. The pin members 41 are formed of yieldable material and each has one end securely mounted on the rear plate 20 with the other free end extending through the opening 42 and into the slot 44. All pin members 41 are located in horizontal alignment below the access passageway 24 and are spaced apart from each other. A chamfered cavity 48 is formed in the plate 20 around each pin member 41 to enable bending of the pin member 41 between a relaxed or first position shown in FIG. 3 and a flexed or second position shown in FIGS. 6 and 7. In an unstressed condition, the pin members 41 are in their first positions, and in their second positions, the pin members 41 are not stressed beyond the elastic limit so that when released, the pins 41 will be returned by their inherent resiliency to their first positions on the lock plate 38. A plurality of channels 50 having inclined or angled side walls or surfaces 52 are formed in the bottom edge of the lock plate 38. As a result, the plate 38 has a bottom edge formed with tapered teeth 51, the number of which can be varied. At their upper ends, the channels 50 communicate with horizontally extending recesses or pockets 55 having bottom walls or ledges 54 which intersect the upper ends of associated inclined surfaces 52.

Figure 3:
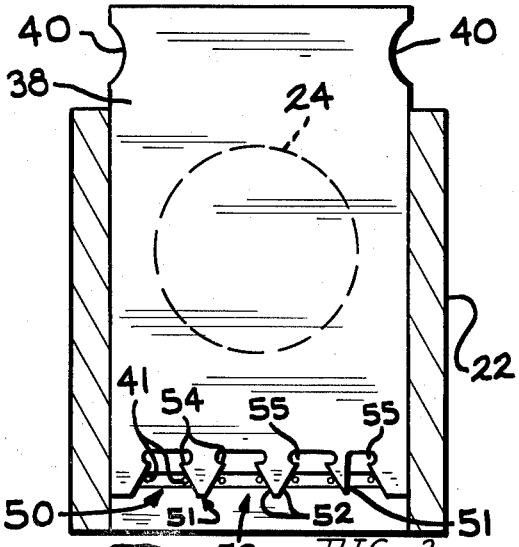
FIG. 3 is a vertical sectional view in section of the apparatus of this invention showing a lock plate being inserted to an access-limiting position.

It can thus be seen in FIG. 3 that the right-most channel 50 is provided with a single inclined surface 52 above which is provided a horizontal ledge 54. The opposite surface is generally vertical and does not engage a pin member 41. When the lock plate 38 is moved downwardly in the channel 28 toward its locked position, the inclined surfaces 52 of the channels 50 engage the pin members 41. Further downward movement of the lock plate 38 causes the pin members 41 to be moved horizontally toward their second positions as they ride on the inclined surfaces 52. When the lock plate 38 is in its lower-most or locked position, the pins 41 will be positioned in alignment with the recesses 55 and due to the resiliency of their construction, the pin members 41 will spring back to their first positions and into the recesses 55. Any attempt to remove the lock plate 38 is prevented by the ledges 54 engaging the pin members 41.

The lock plate 38 can only be removed if all of the pins 41 are simultaneously moved out of the recesses 55. A key plate 60 is provided which is matched with the lock plate 38 and which operates to engage and move the pin members 41 out of their associated recesses 55 to release the lock plate 38 from its locked position. The key plate 60 is rectangular in shape corresponding to the rectangular shape of the channel 30 into which it is slidably fitted and has teeth 61 at its lower edge which are identical in number and shape to the teeth 51 on the matching lock plate.

Figure 5:
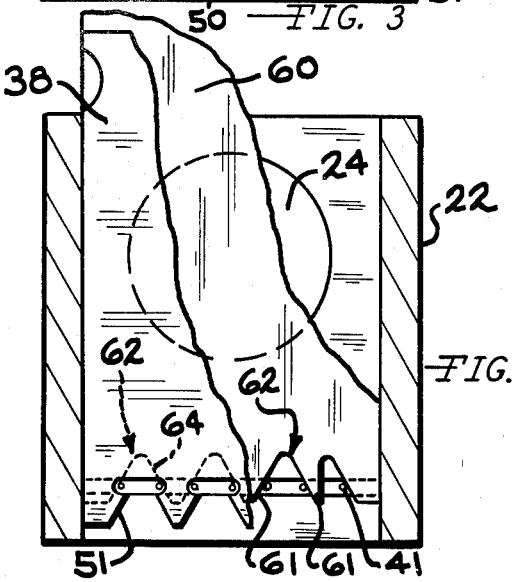
FIG. 5 is a sectional view like FIG. 4 showing the lock plate in its locked position and showing a key plate in a position being inserted to a position to release the lock plate.
Figure 6:
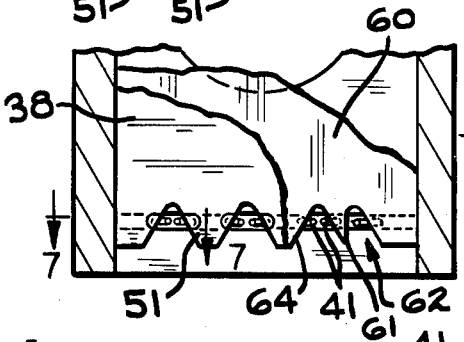
FIG. 6 is a fragmentary sectional view, like FIG. 5, showing the key plate in a fully inserted position in which the lock plate is released.
Figure 7:
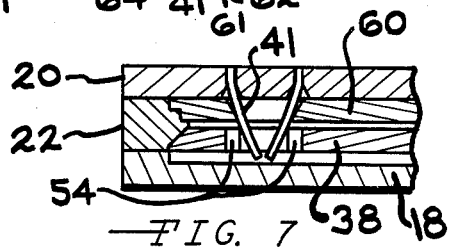
FIG. 7 is a fragmentary sectional view of the access-limiting apparatus of this invention taken substantially along line 7—7 in FIG. 6.

Lock release means is provided at the bottom of the key plate 60 to move the pin members 41 their second positions in response to movement of the key plate downwardly in the channel 30. The lock release means comprises a plurality of channels 62 having inclined walls or surfaces 64. The inclined surfaces 64 have similar angles of inclination and are located at the same locations as the inclined surfaces 52 of the channels 50 when the lock plate 38 and the key plate 60 are placed side by side. The key plate 60, however, does not have any recesses formed at the upper portions of the channels 62. Thus, when the key plate 60 is moved downwardly in the channel 30, the inclined surfaces 64 engage and move the pin members 41 to their second positions in clearance relation with the lock plate 38. It is seen in FIG. 5 that the lock plate 38 is in the locked position with the pin members 41 positioned in the recesses 55. The key plate 60 is shown behind the lock plate 38 at a position in which the angled surfaces 64 first engage the pin members 41. Further movement of the key plate 60 downwardly results in the angled surfaces 64 moving the pin members 41 their second positions as shown in FIG. 6 and 7. In their second positions, the pin members 41 are in clearance relation with the recesses 55 on the lock plate 38 thereby releasing the lock plate 38 from its locked position. The lock plate 38 and the key plate 60 can then both be removed from their respective channels 28 and 30 to open the access passageway 24.

It is to be understood that the lock means can take many forms within the scope of this invention. For instance, the lock plate 38 can be constructed so that only a preselected number of the pin members 41 are located in associated recesses 55 in the locked position of the key plate 38 while the remaining pin members 41 do not act to secure the lock plate 38. Thus, if an unmatched key plate 60 is used in an attempt to release the lock plate 38, at least some of the pin members 41 will not be moved out of their associated recesses 55 or one or more of those pin members 41 that were not securing the lock plate 38 in position would be moved to a position in a recess 55. As can be seen, lock plates 38 having various combinations of arrangements of recesses 55 can be constructed so that numerous lock plates 38 and key plates 60 can be used in conjunction with a single body 16. A guest at a hotel can be given a matched pair of key and lock plates that were picked randomly from a collection of lock and key plates. In this manner, the guest, in addition to being provided with additional security, will not be tempted to have a duplicate key made knowing that the next guest will probably hav a different pair of lock and key plates.

It can also be appreciated that the lock device 10 can be used in connection with a variety of controls. The body 16 can, for example, be mounted over a light switch, a thermostat, a machine control or the like. Access to these components will be prevented when the access passageway 24 is blocked by the lock plate 38. Only the person having the properly matched key plate 60 will be able to remove the lock plate 38 and gain access to the secured position.

In the operation of the apparatus 10, assume that the lock plate 38 is in the position illustrated in FIG. 3. The inclined surfaces 52 are in engagement with the pin members 41 which are in their first positions. In response to movement of the lock plate 38 downwardly, the pin members 41 are deflected by the inclined surfaces 52 and moved toward their second positions illustrated in FIG. 7. As the inclined surfaces 52 move past the pin members 41, the pin members 41 will snap back to their first positions and move into the recesses 55 where they are positioned over the ledges 54 thereby preventing the removal of the lock plate 38 from the body 16. The lock plate 38 can be released from the body 16 only by inserting the proper key plate 60 into the channel 30 as shown in FIGS. 5–7. The inclined surfaces 62 on the key plate 60 engage the pin members 41 in response to movement of the key plate 60 downwardly. Further downward movement of the key plate 60 causes the pin members 41 to be deflected to their second positions as shown in FIGS. 6 and 7. The pin members 41 are thus moved out of their positions over the ledges 54 thereby enabling the release of the lock plate 38 from the body 16.

From the above description, it is seen that improved tamper-proof, access-limiting apparatus 10 has been provided. The device 10 is simple and inexpensive to manufacture and is useful in a variety of environments. The number and shape of the teeth 51 and 61 on the plates 38 and 60 can be varied so long as the working teeth on matching plates are identical. By "working teeth" is meant teeth that engage pins 41, it being apparent that non-working teeth may be used to enhance the security of the apparatus 10. It is also to be understood that while the invention has been described in detail with respect to a form of the invention in which bendable pins are secured to the body, it is within the scope of the invention to use pins of other forms supported in different ways to effect locking of the lock plate. The number of pins 41 can be varied and the larger the number of pins used, the greater the number of different lock plates 38 that can be used with a single device 10. For example, if seven pins 41 are used, 128 different lock plates 38 can be constructed.

What is claimed:

1. Access-limiting apparatus comprising a body having front and rear walls, means forming a longitudinal passageway through said body extending through said front and rear walls, means forming a second passageway through said body extending transversely of and intersecting said first passageway between said front and rear walls, a lock plate movable in said second passageway to a locked position closing said first passageway, coacting lock means on said body and said lock plate for securing said lock plate in said locked position, and a key plate having lock release means thereon engageable with said lock means to release said lock plate from said locked position.

2. Access-limiting apparatus according to claim 1 wherein said lock means includes at least one pin member mounted on said body and extending across said second passageway at a location spaced from said first passageway, and pin retainer means on said lock plate for engaging said pin member in the locked position of said lock plate to prevent the release of said lock plate from said locked position.

3. Access-limiting apparatus according to claim 2 wherein said pin member is movable between a first position in which said pin member is engageable with said pin retainer means and a second position displaced from said first position in which said pin member is in clearance relation with said pin retaining means.

4. Access-limiting apparatus according to claim 3 wherein said lock release means comprises a channel formed in said key plate and having an angled face engageable with said pin member and operable to move said pin member to said second position.

5. Access-limiting apparatus according to claim 4 wherein said lock means further includes a channel formed in said lock plate and having an angled surface, said angled surface being located adjacent to said pin retainer means and being operable to engage and displace said pin to said second position in response to movement of said lock plate toward said locked position, and means providing for the return movement of said pin to said first position when said lock plate is in said locked position to thereby provide for the cooperation of said pin with said pin retainer means to secure said lock plate in said locked position.

6. Access-limiting apparatus according to claim 5 wherein said pin member extends across said second passageway in a direction longitudinally of said body.

7. Access-limiting apparatus according to claim 1 wherein said lock means comprises a plurality of pin members, means supporting said pin members on said body in spaced relation with each other and in positions in which each pin member extends substantially across said second passageway, each of said pin members being movable between a first position and a second position displaced from said first position, and pin retainer means on said lock plate for engaging preselected ones of said pin members in said first positions thereof to secure said lock plate in said locked position.

8. Access-limiting apparatus according to claim 7 wherein said lock release means comprises a plurality of channels formed in said key plate and having angled surfaces, said angled surfaces being operable in response to movement of said key plate toward said pin members to engage and move said preselected pin members from said first to said second positions, preselected pin members in said second positions thereof being in a clearance relation with said pin retaining means to enable release of said lock plate from said body.

9. Access-limiting apparatus according to claim 8 wherein said pin retainer means comprises means forming a plurality of recesses in said lock plate into which said preselected pin members are disposed in the locked position of said lock plate.

10. Lock apparatus comprising a body having passageway means therein, pin means extending transversely of and projecting into said passageway, a lock plate slidably mounted in said passageway means and having teeth engageable with said pin means, said teeth being operable on movement of said lock plate in one direction to deflect said pin means and enable movement of said teeth to positions in which said pin means blocks movement of said lock plate in an opposite direction, and a key plate having teeth thereon identical to said lock plate teeth and movable in said passageway means to a position in which the teeth thereon are engageable with said pin means, said key plate teeth being operable to deflect said pin means to release said lock plate teeth and enable movement of said lock plate in said opposite direction in said passageway means.

11. Apparatus according to claim 10 wherein said teeth are tapered in said one direction.

* * * * *